US009506650B2

(12) United States Patent
Abrahamer

(10) Patent No.: US 9,506,650 B2
(45) Date of Patent: Nov. 29, 2016

(54) FIRE STARTER AND SURVIVAL TOOL

(71) Applicant: Henry Abrahamer, Paradise, CA (US)

(72) Inventor: Henry Abrahamer, Paradise, CA (US)

( * ) Notice: Subject to any disclaimer, the term of this patent is extended or adjusted under 35 U.S.C. 154(b) by 498 days.

(21) Appl. No.: 14/074,656

(22) Filed: Nov. 7, 2013

(65) Prior Publication Data

US 2014/0127633 A1 May 8, 2014

Related U.S. Application Data

(60) Provisional application No. 61/723,766, filed on Nov. 7, 2012.

(51) Int. Cl.
*F23Q 2/38* (2006.01)
*F23Q 2/32* (2006.01)
*F23Q 1/06* (2006.01)

(52) U.S. Cl.
CPC .. *F23Q 2/32* (2013.01); *F23Q 1/06* (2013.01)

(58) Field of Classification Search
CPC ..... A47J 43/25; B23D 71/00; B23D 71/04; B26B 11/00; Y10T 407/18; F23Q 3/32; F23Q 1/06
USPC ..... 431/267; 144/115, 186, 369, 371, 373; 241/95, 273.1; 407/29.1
See application file for complete search history.

(56) References Cited

U.S. PATENT DOCUMENTS 1,100,544 A * 6/1914 Densmore ..... B23D 71/00 30/172
1,332,260 A * 3/1920 Jones ..... A47J 43/25 241/291
1,960,378 A * 5/1934 Hagerling ..... B26B 11/00 30/408
3,815,189 A * 6/1974 Russell ..... B23D 71/00 407/29.1
3,990,134 A * 11/1976 Stoutenberg ..... B23D 71/04 407/29.1
4,028,781 A * 6/1977 Konrad ..... B23D 71/02 407/29.11
4,215,473 A * 8/1980 Elmore ..... B23D 71/06 30/172
4,928,893 A * 5/1990 Prindle ..... A47J 43/25 241/100
5,711,491 A * 1/1998 Molo ..... A47J 43/25 241/100
D642,876 S * 8/2011 Tetreault ..... D7/678
2003/0038195 A1* 2/2003 Coburn ..... A47J 43/25 241/30
2005/0138736 A1* 6/2005 Tarlow ..... A47G 21/06 7/110
2008/0212313 A1* 9/2008 Padden ..... F21V 33/0084 362/119
2013/0095439 A1* 4/2013 Putrello, Jr. ..... F23Q 7/02 431/258

* cited by examiner

*Primary Examiner* — Jorge Pereiro
(74) *Attorney, Agent, or Firm* — Donn K. Harms

(57) ABSTRACT

A survival tool intended for fire starting with a novel tinder generation element which creates fine, elongated slivers of combustible material which ignite and dry easily even in damp or wet environments. The device combination of a pyrophoric element, striker, ignitable material and other optional elements with the elongated tinder generation component reduces the risk of injury and subsequent infection over bladed alternatives, while also containing all required elements for wilderness fire starting in a small convenient package.

10 Claims, 3 Drawing Sheets

FIRE STARTER AND SURVIVAL TOOL

BACKGROUND OF THE INVENTION

1. Field of the Invention

This application is a nonprovisional application of U.S. provisional application No. 61/723,766 filed on Nov. 7, 2012, and is incorporated herein in its entirety by this reference.

The disclosed device relates to survival equipment. More particularly the device herein disclosed and described relates to a device for fire starting which is configured in a combination fire starter and tinder generation component with on board ignition components.

2. Prior Art

For centuries fire has been a critical tool in enabling humans to survive while living or attempting to survive in adverse environmental conditions. While some say water is the single most important requirement for survival, most survivalists will confirm that it is fire that allows a person to actually render water in the wilds potable, and without fire at night, a person will have a much harder time staying warm, as well as deterring predators who view humans as a meal.

Fire provides warmth in cold weather, light in darkness and, as noted, means to kill harmful bacteria and pathogens should a person, lost or surviving in the wilds, happen upon game for food and a water supply. Cooking food over fire to a temperature of at least 160 degrees generally will destroy pathogens, and potable water can be made from pond and collected water through boiling it.

In modern times, the ability to create a fire is often taken for granted. Access to gas powered lighters and chemical tipped matches, provides most people with a general sense of security should they need to light a fire. However, when suddenly positioned in the jungle, forest, desert or other hostile environments, during unexpected emergencies, people generally have no matches or other fire starting components in their possession, since they had not anticipated the situation.

In such cases of emergency, lacking any of the normally employed means for starting a fire, or when locations with restricted access to modern amenities, a fire starting tool can be a life saving device through allowing a user to more easily ignite combustible material they gather, conventionally called tinder.

A number of prior art means for igniting a fire are employed widely such as stick matches, fuel powered lighters, magnesium bars, and flint rods and the like. However, in order to take advantage of these ignition tools such as pyrophoric elements and strikers, tinder is an almost certain requirement to start a fire absent possession of fire accelerators such as lighter fuel.

In situations where a fire is required, be it an emergency or just individuals camping in the outdoors, tinder for starting a fire using larger combustibles such as wood branches, is generally gathered by finding local materials. Good tinder includes materials such as dry grass, bird nests, straw and other materials which have large areas of easily ignited surfaces. Once tinder is ignited, it is conventionally employed to ignite the main fire of wood branches, sticks of wood and other longer burning combustibles. However, there are many occasions and emergency situations where there is no tinder material in the general vicinity or where rain has rendered all the exposed ignitable materials such as grasses, un-ignitable since once wet they lack a large exposed side surface which easily ignites when combined with a spark or the like.

Prior at has offered some attempted solutions to such problems, for instance Patent EP0570175 A1 shows a survival tool possessing several components necessary for fire starting, including a storage receptacle to bring along tinder or matches for fire starting. However, the device does require the foresight to make and store tinder in the device to compliment any magnesium shavings and lacks any means to create tinder once the supply, if brought in the first place, runs out. In emergency situations, where local tinder is non existent or rendered unusable, to have some means for generating tinder similar to natural optimum tinder such as straw or bird nests, which are endowed with long exposed ignitable side surfaces which ignite easily with a spark and then burn hot for a prolonged period as the flames progress through the stringy straw or nest material.

Such elongated burning gives the fire starting user the ability to ignite the tinder and have the time to position the burning tinder next to the larger wood before it extinguishes. With the elongated material such as straw, dried grasses, or woven birds nests, such is provided. Having means to artificially generate such stringy material for tinder, at will, in combination with a fire starting component, would thus render the user's chances of repeatedly building fires for survival, much better than just having matches or flint and steel. Multiple uses to generate tinder is especially important even if there is local tinder available for a first fire. This is because the main reason a survival fire is extinguished is rain, which also renders all local tinder unuseable for a subsequent fire.

U.S. Pat. No. 4,698,068 teaches a survival knife tool that may be used to create tinder and contains fire starting tools such as magnesium and pyrophoric elements in a compartment. However, when local tinder is unavailable or rendered unuseable, creating elongated, thin, optimally shaped tinder with a small knife is not possible and additionally places the user in a dangerous position where they might be injured by a sharp blade which would create a dire situation if the user is surviving in the wild with no help for miles or for many days. In such an emergency or wilderness situation a knife cut or wound not only risks severe bleeding from cuts, it also creates a significant increase in the risk of infection, even with small cuts.

The main shortcoming in the field of fire starting devices, in the cited and other prior art, is the lack of components configured to safely and repeatedly generate tinder of optimum ignition quality which is well known to be thin material which has easily ignitable side surfaces and is elongated. The elongation is especially important to allow time for positioning the burning tinder to start the fire, as well as to provide optimum communication with oxygen in the atmosphere in the fire infancy stage. It is during this start up period where short pieces of wood and sticks and other kindling and tinder fail since they can expose bark or otherwise protected side surfaces and be short in length causing loss of flame due to lack of oxygen and too much smoke.

As such, there is a continuing unmet need for an improved fire starting device which combines current survival fire starting and survival tool components, with a tinder-generating element capable of creating optimally shaped elongated shaving and slivers possessing high surface area to volume ratios. Such a tinder generating component should be such that the user is not easily injured using it. Such a tinder generating component should easily be employed repeatedly and continue to easily generate optimum tinder. Finally, such a survival device in the noted combination, should be compact and easily carried as one self-contained unit to encourage carrying it even when an emergency is not anticipated. Finally, such a device should be configured with all the required tools for fire starting in various survival situations.

SUMMARY OF THE INVENTION

The device and method of manufacture and employment herein disclosed and described achieves the above-mentioned goals and remedies the noted shortcomings of prior art. It accomplishes this significant utility through the provision of a survival tool possessing a means to generate heat or a flame to ignite tinder such as pyrophoric material, a striker to ignite the pyrophoric material, an ignitable material resource, and in particular, a means to repeatedly generate elongated and optimally ignitable tinder, from branches and other ignitable materials which even if wet on the outside, can yield significant quantities of tinder from dry interiors with the device herein.

An optimum quantity of easily ignited tinder is created using a planar member having grating or planing components positioned thereon. Once a sufficient quantity of elongated tinder is generated, it is placed in a pile. If present, the addition of easily ignitable material such as magnesium shavings yields the optimum chance for igniting the tinder, however using the device herein, if magnesium or the like is not present, the generated tinder in optimum condition gives the user a much better chance of fire starting success.

This collection of elongated tinder pieces and if present, ignitable material is ignited using means of ignition. This can be in the form of a lighter or matchstick if present, or as is the case in many survival situations, through a showering of sparks onto the tinder mixture. Such sparks are usually generated from the striking of a pyrophoric material. The pyrophoric material is often referred to as a flint rod. Sparks are generated when it is either impacted or scraped with a striker element which is usually a piece of metal alloy with a rough or sharp edge. In a mode of the device herein, the striker element may be in the shape of a can opener, bottle opener or the like. It may also be attached to the device by a tether which might also double as a cable-saw.

The device mentioned herein provides these required fire starting components and elongated tinder generation component, into a compact and easily transported tool device. The form factor of the device is such that it may be easily placed in a pocket, bag or survival kit. This device as noted, provides the novel improvement over currently available products through the incorporation of the unique tinder generation element which may be engaged to the body of the device which provides an excellent grip during use. When translated over the surfaces of combustible material like branches, the tinder generating element works in a plane-like action to generate elongated pieces of tinder having large area side surfaces which more easily ignite and communicate with the oxygen supply subsequent to ignition.

The tinder creating element is designed and formed in such a way that it creates elongated, thin slivers with a spaghetti-like structure which as noted, facilitates fire starting in outdoor and emergency situations. When translating across the surface of wood or other combustible material, the tinder generation component grating allows fine, thin and elongated slivers to enter a cavity within the element or to exit the cavity from the rear during use when full.

From the cavity behind the wall forming the tinder generating component, the elongated tinder slivers may be dumped, pushed out with a finger or a striker element or simply left stored for later use. As noted the elongated shape of the newly formed tinder, with large ignitable surface areas, is highly conducive to ignition and dehydration.

The tinder creating element is attached to the device so that it may be employed much like a planing tool, grater or rasp on branches, sticks, cardboard, and other ignitable material. This exterior positioning on the body of the device, in conjunction with an elongated planar or arched shape, provides a tinder generation element, which is repeatedly employable, to generate optimum configured elongated tinder much more safely than conventional knives and blades. This as noted, eliminates the likelihood of serious injury and subsequent infection.

The overall exterior surface and configuration of the device may vary in shape to incorporate many other survival items and components. The form may also vary to allow for different ergonomic designs which cater to different components and device capabilities. The device may be tubular in shape with threaded complimentary components to allow for dry internal storage of tinder, matches and sharp edge elements. The device may be rectangular and large to ease the holding and use of the planing element, or may be cylindrically shaped in a puck-like form for easier transport and storage. The device may also possess flashlight, knife, can-opener, bottle-opener, retractable cable saw, holster, key-chain or belt clip elements.

Some modes of the device may incorporate the aforementioned tools such as can and bottle openers, knives and files into the striker blade component. Additionally, some modes may provided a stick match or lighter storage cavity. If using a striker it may be stored in a cavity defined by the rear wall of the tinder generating component. The striker component may also be tethered to the device to prevent loss and misplacement. In a particularly preferred mode of a multi functional survival tool, the tether may be of dual purpose in the form of a cable saw blade or sharp wire. The tether may be retractable for when in storage, or wrapped around the body of the device.

It is an object of the device in this application to provide an improved fire staring device for recreational and emergency use.

It is a further object of the device in this application to provide such a fire starting device, which has an on-board tinder generating component configured to generate elongated strands of tinder with large combustible surfaces areas thereby providing a tinder supply which maximizes the prospect of fire starting.

It is a further object of this device to provide such a tinder generation component, which is deployable by itself or in a configuration adapted to engage another tool such as a knife or flashlight.

These together with other objects and advantages which become subsequently apparent reside in the details of the construction and operation as more fully hereinafter described and claimed, reference being had to the accompanying drawings forming a part thereof, wherein like numerals refer to like parts throughout.

With respect to the above summary, before explaining at least one preferred embodiment of the herein disclosed fire starter tinder generating survival tool in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

Figure 2:
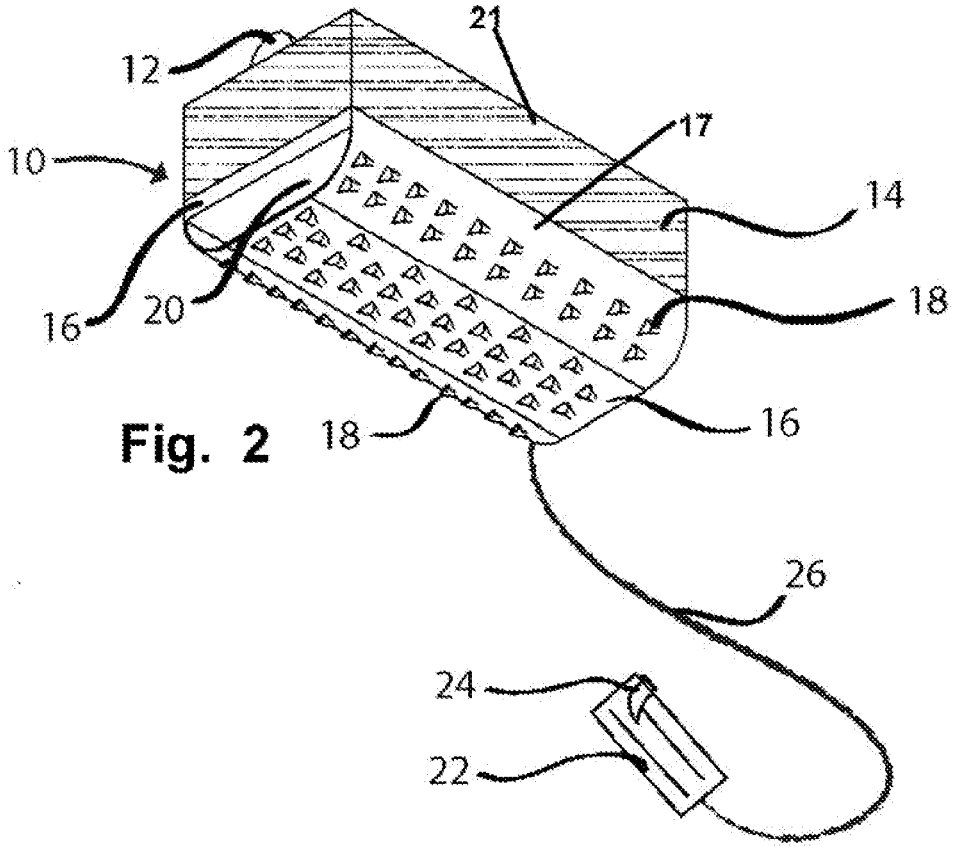
FIG. 2 is a bottom-perspective view of the device in a rectangular embodiment.
Figure 2A:
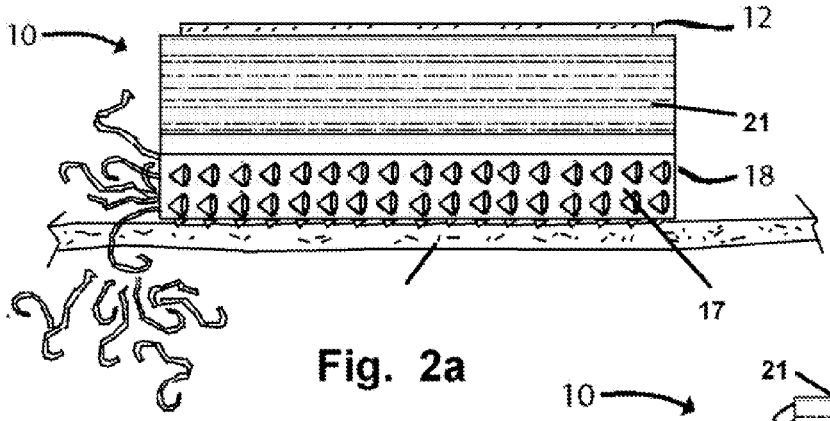

FIG. 2*a* depicts a side view of the device in an as-used mode to generated the depicted elongated tinder pieces.

Figure 3:
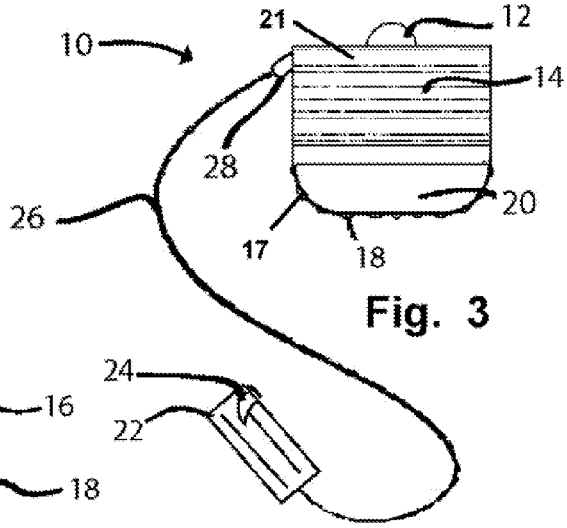

FIG. 3 depicts an end view of the device in a rectangular embodiment.

Figure 4:
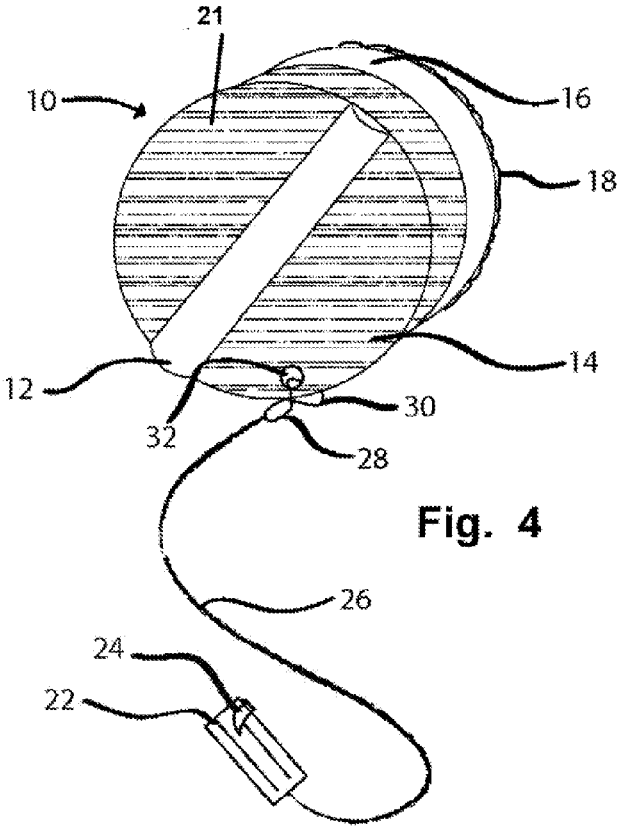

FIG. 4 depicts a top-perspective view of the device in a puck-like embodiment.

Figure 5:
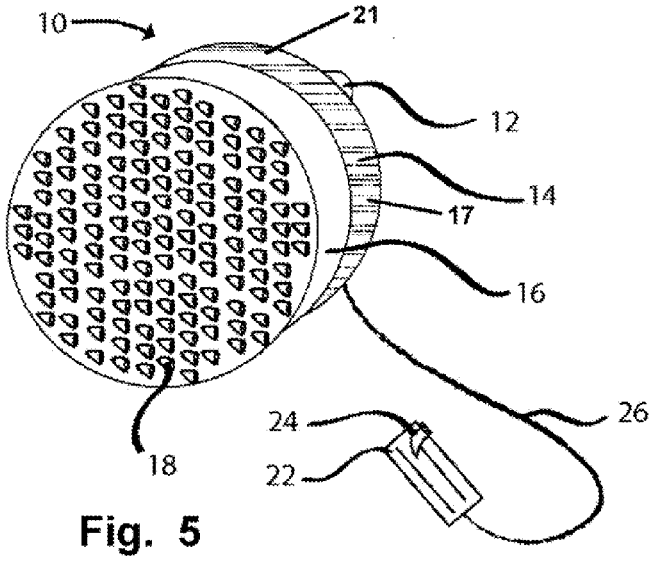

FIG. 5 depicts a bottom-perspective view of the device in a puck-like embodiment.

Figure 6:
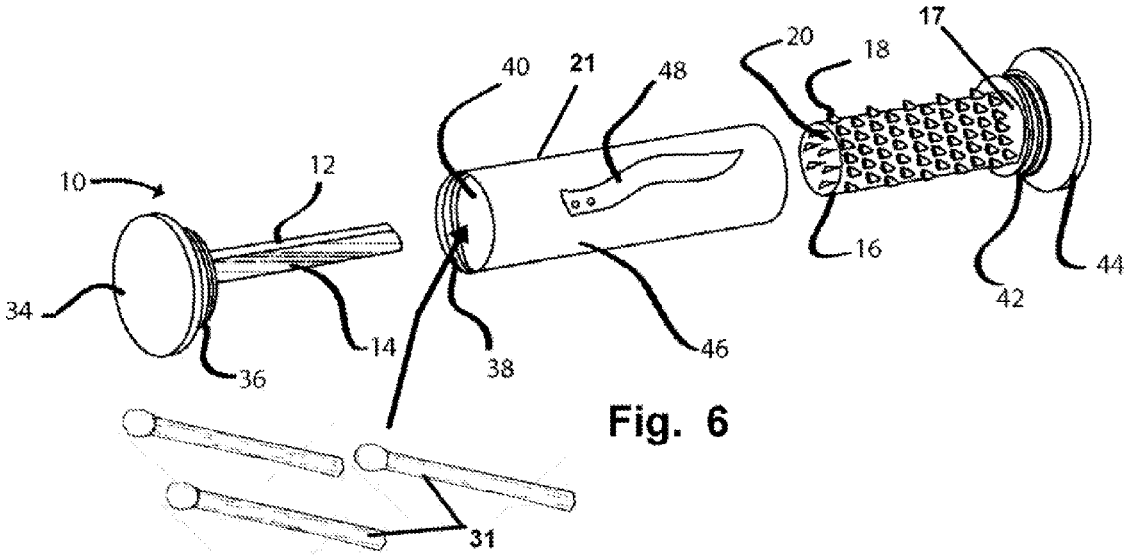

FIG. 6 depicts a perspective, exploded view of the device in a tubular embodiment.

DETAILED DESCRIPTION OF THE PREFERRED EMBODIMENTS OF THE INVENTION

Referring now to the drawings of FIGS. 1-6, there are depicted various modes of the device 10 which are all configured for generating elongated tinder from wood or materials generally not conducive to such using conventional means, and rendering the user able to ignite the generated tinder in recreational, survival and wilderness scenarios.

Figure 1:
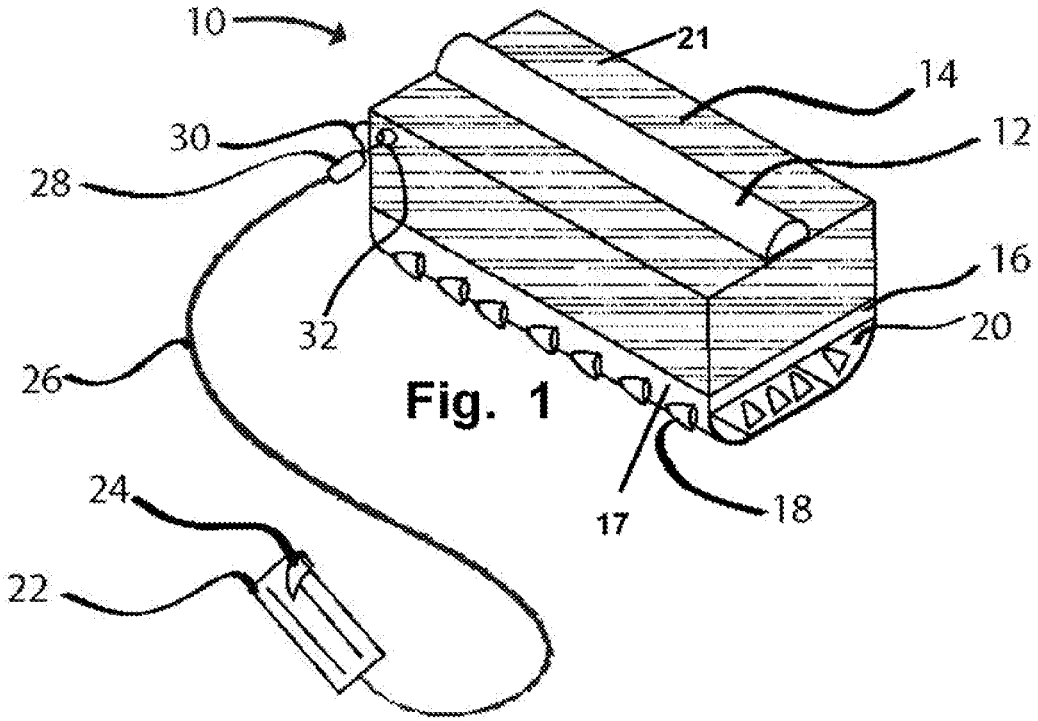
FIG. 1 is a top-perspective view of the device in a rectangular embodiment.

In FIG. 1, a top-perspective view of the device 10 is shown in a rectangular configuration of the device 10 which has a body 21 portion which will double as a handle, and storage housing, during use of the tinder generation component 16. Here the pyrophoric element 12 is embedded into the ignitable material such as a member of magnesium 14. Attached to the magnesium 14 is the member 17 providing the shape for the grating or planing tinder generation component 16 which may be rounded or arched in a particular favorite as shown, or planar formed.

The tinder generation component 16 is formed so that a plurality of planing or grating slots 18 are present in a projecting array or pattern. These outwardly protruding slots 18 project at an angle to yield openings which individually slice and break through the outer surface of combustible materials such as wood and branches as depicted in FIG. 2*a*. The slots 18 are formed with an aperture communicating through the housing for the slots 18 which preferably has a sharp leading edge. The aperture forming the opening is sized to create the elongated tinder slivers 19 which accumulate in the cavity 20 defined by the rear wall of the tinder generation component 16 during forced translation across the material surface such as the wood branch 19 shown in FIG. 2*a*.

Once an appropriate amount of tinder 19 is generated and collected in the cavity 20 it may be pushed out using a finger, or the striker 22 shown or simply tapped out. This striker 22 is shown and formed as a metal alloy and has a collapsible can-opener 24 on the distal end. It may also be formed as a bottle opener or knife blade. If magnesium 14 is present, once the tinder 19 is removed from the cavity 20 the striker 22 is used to create and place magnesium shavings from the magnesium 14 onto a piling of the tinder 19 by scraping. The striker may be tethered to the device 10 with a cable-saw tether 26 as shown to prevent loss and to incorporate a saw tool into the compact design of the device 10.

It should be noted that a primary preferred mode of the device 10, employs the member 17 in either a planar, curved, circular, or arched form, and with angled projections or slots 18 having apertures sized and configured to generate the unique elongated easily ignitable shape of the generated tinder 19, housed in combination with means for ignition of the more easily ignited elongated tinder 19. The shape of the tinder 17 tends to be elongated which sidewalls exposed having an area larger than the area of the tinder 17 between the sidewalls thereby exposing more area that ignites easily, and maintains oxygen contact.

The arched mode of the member 17 engaged on a body 21 which can double as a storage housing of FIG. 1 is a particular favorite as it positions the tinder generating projections or slots 18 on bottom and side projecting edges which works better with curved branches and the like. Means for ignition of the tinder 19, preferably housed or provided therewith, can include fuel powered lighting implements such as cigarette lighters or matches 31 or other means for ignition of the tinder 19 might be employed. Particularly preferred other than fuel powered lighting implements are a supply of magnesium for mixing with the elongated tinder 19 and a means for spark generation such as the disclosed flint and steel.

Due to the unique ignition and continued flame provided by the elongated tinder 19 generating component 16, the device 10 when configured with any means to ignite the tinder 19 provides users a significant advantage in making a fire since the tinder 19 in this configuration exposes more flammable side surfaces for ignition and allows communication with oxygen better long the entire strand. Further while the combination with an ignition means and other tools for survival is preferred, the tinder generation component 16 can yield a significant advantage over prior art when simply employed to generate tinder 19, of significantly improved shape and elongation by itself or engaged to another body 21 formed of a flashlight or the like. As such, any device which employs and mode of tinder generation component 16 employing a member 17 which is curved or planar with projections and slots configured to generate elongated tinder 19, is anticipated within the scope of this patent.

Also preferred in a combination survival type device is the cable-saw which doubles as a tether 26 which is attached to the body 21 of the device 10 by a crimp connection 28 to a loop 30 through a hole 32 in the magnesium 14 shown, or alternatively it may be attached to a retractable storage element to facilitate storage when not in use.

After tinder 19 and magnesium 14 shavings are collected, the striker 22 is used to impact or scrape the pyrophoric element 12, thereby showering the tinder and shavings in sparks. This showering of sparks ignites the magnesium shavings which in turn begins the combustion of the tinder.

This tinder combustion process creates a fire that is able to ignite other larger combustible materials such as the source of the created tinder.

FIGS. 2 and 3 illustrate the same aforementioned However the means for ignition of the tinder 19 can be the pyrophoric element 12 or can be other means for ignition of the tinder 19 such as matches or a lighter stored in the body 21. The rectangular body 21 configuration of the device 10 is shown in different views to depict the device 10 structure and show the member 17 shape and projections.

FIG. 2 provides another perspective of the curved tinder generation component 16, and FIG. 3 provides an improved view of the protruding slots 18, as well as the cavity 20. This cavity may have caps to contain tinder slivers 19 for storage, or the entire device 10 may be placed within a case.

FIGS. 4 and 5 illustrate a cylindrical puck-shaped body 21 for the device 10. The same elements described previously and shown in FIGS. 1-3 are still present and used to the same effect. FIG. 4 illustrates the top perspective view of the device 10 where the magnesium 14 and pyrophoric elements are clearly shown. Also shown with greater detail is the hole 32, loop 30 and crimping attachment 28 to the cable-saw 26. A significant difference in this puck embodiment of the device 10 versus the rectangular embodiment is the addition of complimentary mating threads that allow the tinder generation component 16 and the magnesium 14 elements to concentrically attach and separate with one another. This threaded mating allows the hollow tinder generation component 16 to create a fully enclosed cavity 20 in which tinder may be stored until needed. When the tinder is needed and ready for ignition the magnesium 14 and tinder generation component 16 components may be unscrewed from each other thereby and the tinder may be removed.

FIG. 5 shows the puck shaped body 21 from the bottom perspective, better illustrating the array of protruding slots 18, and the side surface of the tinder generation component 16. There are no slots 18 on the side surface by design to allow a user to hold the device 10 more firmly without risk of laceration.

FIG. 6 illustrates a tubular mode of the body 21 of the device 10 in an open, exploded view. This mode could be a tubular hollow body 21 with storage, or a flashlight body 21 with or without storage inside, if the flashlight were just engaged with the member 17 to be able to generate tinder 19. This will allow the member 17 with projections to be sold separately for retrofit to conventional flashlights since they are substantially the same diameter depending on internal batteries and the member 17 can be sapped for mass production and frictional or mechanical attachment to a body 21 provided by a flashlight. In FIG. 6, the pyrophoric element 12 can be either embedded into the magnesium 14, but they are both now in rod shaped form and attached to the ignition endcap 34. Or other means for ignition of the tinder generated can be provided such a matches 31 or a lighter or combinations thereof is desired.

The depicted ignition endcap 34 possess a circumference area with threaded-surface 36 which is complimentary to the tubular-housing ignition threaded-surface 38 present on the tubular housing 40. This allows the magnesium 14 and pyrophoric element 12 to be secured within the tubular housing 40 for storage and protection. If matches 31 or a cigarette lighter are provided instead or along with as a supplement pyrophoric element, they can be housed within the chamber formed in the tubular housing 40.

On the opposite or distal end of the tubular housing 40 forming the body 21 in this mode, the tubular-housing's a projecting tubular member 17, forms the tinder generation component from an end cap 44 having a threaded-surface 42 that is complimentary to threads 38 in the other end of the tubular housing 40 providing the body 21. The tinder generation component is shown engaged to a surrounded by the threaded-surface 42 formed onto the tinder generation component endcap 44.

This tinder generation component projecting from the endcap 44 is attached to the tubular tinder generation component 16 which is shown with the protruding slots 18 for elongated and high surface area, tinder creation. Elongated tinder slivers 19 (FIG. 2*a*) may accumulate in the center cavity 20 and may be removed by removing the tinder generation component endcap 44 and pushing the slivers out with the magnesium 14 and pyrophoric element 12.

In the closed storage mode of the device 10 of FIG. 6, the magnesium 14 and pyrophoric element 12 rest axially within the cavity 20 of the tinder generation component 16 to conserve space and minimize the form factor. Other items may also be stored within such as matches 31 or tinder. This axially aligned mode of the device yields the most compact body 21 and is preferred due to easy pocket storage for transport.

On the external surface of the tubular-housing 46 is a belt-clip attachment 48. This belt-clip attachment 48 may be removable and may also act as a striker tool to impact or scrape the pyrophoric element 12 thereby creating sparks and igniting the magnesium shavings. It may also possess all of the aforementioned tools of the striker 22 such as the folding can-opener 24. The same external components may be positioned on a flashlight mode of the tubular body 21, and, instead of having the end cap 34 engage with a tubular body, it could axially position the combination magnesium 14 and pyrophoric element 12 withing the circular member 17 and engage on the end opposite the second endcap 44.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A survival tool apparatus, comprising:

a body, a member;

said member engageable to said body to an engaged position;

a first side surface of said member positioned a distance from one side of said body when in said engaged position;

a first cavity between said first side surface of said member and said side of said body;

said member having a plurality of projections extending therefrom in a direction away from said body, from a base edge of said projections at or adjacent said member, to respective distal ends;

apertures communicating through said member at respective positions adjacent said base edge of said projections;

said distal ends of said projections, when positioned in a sliding communication against combustible material, thereby generating elongated strands thereof during said sliding communication;

a second cavity formed in said body;

means for ignition of said elongated strands in a removable engagement within said second cavity;

said means for ignition employable to start a burning of said elongated strands;

said elongated strands having an exterior circumferential surface defining an interior area of said strands;

said distal ends of said projections spaced a distance from said member to define said circumferential surface of said elongated strands to exceed said interior area of said elongated strands thereby generating said elongated strands in a configuration having an area of said exterior circumferential surface size exceeding a cross section size of said interior area, thereby maximizing said circumferential surface area exposable to said means for ignition and an oxygen exposure, to maintain said burning of said strands;

said respective apertures adjacent each respective said base edge being larger than a cross section of said circumferential surface and defining a pathway for said elongated strands, into said cavity, whereby each said sliding communication generates a plurality of said elongated strands which are communicated to said cavity; and at least one opening communicating with said cavity, said opening defining a pathway for a removal of said elongated strands, whereby said elongated strands of combustible material are removable therethrough by a user, for subsequent employment as tinder to start a fire.

2. The survival tool of claim 1 additionally comprising:

said member formed in an arch shape; and said arch shape forming a curved array of said plurality of projections extending therefrom; and said curved array allowing generation of said elongated strands in said sliding communication against planar or curved combustible material.

3. The survival tool of claim 2 wherein said means for ignition employable to start a said burning of said strands comprises:

magnesium particles;

a flint member;

a steel tool configured to generate sparks on impact with said flint member.

4. The survival tool of claim 3 additionally comprising:

a tether engaged between said body and said steel tool;

said tether being a cable saw.

5. The survival tool of claim 2 wherein said means for ignition employable to start a said burning of said strands comprises:

one or a combination of igniters from a group including matches and a fueled lighter.

6. The survival tool of claim 2 additionally comprising:

said body being a tube having an axial cavity;

a first end cap having a projecting member formed of magnesium and magnesium and a pyrophoric element;

said first end cap removably engageable with a first end of said tube to an engaged position with said projecting member axially positioned in said axial cavity;

a second endcap removably engageable with a second end of said tube;

said member formed to a circular configuration and defining said cavity axially therein;

said member engaged at a first end to said second end cap and having said opening as an opposite end; and said member axially positioned within said axial cavity with said second end cap engaged to said second end of said tube.

7. The survival tool of claim 1 wherein said means for ignition employable to start a said burning of said strands comprises:

magnesium particles;

a flint member;

a steel tool configured to generate sparks on impact with said flint member.

8. The survival tool of claim 7 additionally comprising:

a tether engaged between said body and said steel tool;

said tether being a cable saw.

9. The survival tool of claim 1 wherein said means for ignition employable to start a said burning of said strands comprises:

one or a combination of igniters from a group including matches and a fueled lighter.

10. The survival tool of claim 1 additionally comprising:

said body being a flashlight.

* * * * *